US009337588B2

(12) United States Patent
Chang

(10) Patent No.: US 9,337,588 B2
(45) Date of Patent: May 10, 2016

(54) UNIVERSAL SERIAL BUS CONNECTOR

(71) Applicant: SPEED TECH CORP., Taoyuan (TW)

(72) Inventor: Hua-Chun Chang, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 14/667,677

(22) Filed: Mar. 25, 2015

(65) Prior Publication Data

US 2015/0311645 A1 Oct. 29, 2015

(30) Foreign Application Priority Data

Apr. 28, 2014 (TW) ..... 103207409 U

(51) Int. Cl.

| | |
|---|---|
| ***H01R 13/648*** | (2006.01) |
| ***H01R 13/6594*** | (2011.01) |
| *H01R 12/72* | (2011.01) |
| *H01R 24/60* | (2011.01) |

(52) U.S. Cl.

CPC ..... *H01R 13/6594* (2013.01); *H01R 12/724* (2013.01); *H01R 24/60* (2013.01)

(58) Field of Classification Search

CPC .... H01R 9/03; H01R 13/648; H01R 13/6594; H01R 12/724; H01R 12/722; H01R 24/50

USPC ..... 439/607.28, 607.05, 607.27, 607.07, 439/607.09, 607.11, 607.13, 607.32, 439/607.35, 607.39, 607.4, 607.45, 497, 439/660

See application file for complete search history.

(56) References Cited

U.S. PATENT DOCUMENTS

| | | | | |
|---|---|---|---|---|
| 7,758,379 | B2 * | 7/2010 | Chen | H01R 13/6584 439/607.11 |
| 8,808,029 | B2 * | 8/2014 | Castillo | H01R 13/6585 439/607.05 |
| 8,851,927 | B2 * | 10/2014 | Hsu | H01R 13/6594 439/607.11 |
| 9,178,319 | B2 * | 11/2015 | Little | H01R 13/6585 439/607.4 |

FOREIGN PATENT DOCUMENTS

TW M367498 U 10/2009

* cited by examiner

*Primary Examiner* — Abdullah Riyami
*Assistant Examiner* — Harshad Patel
(74) *Attorney, Agent, or Firm* — CKC & Partners Co., Ltd.

(57) ABSTRACT

A universal serial bus connector includes a shielding case, an insulating main body, a first terminal group, a second terminal group and a grounding sheet. The insulating main body is accommodated and installed in the shielding case. The first terminal group is accommodated in the insulating main body. The second terminal group is accommodated in the insulating main body. The grounding sheet is fixed on the insulating main body. A surface of the shielding case has at least one bump. The bump is recessed inwards from the surface, such that the bump is electrically connected with the grounding sheet.

8 Claims, 11 Drawing Sheets

UNIVERSAL SERIAL BUS CONNECTOR

RELATED APPLICATIONS

This application claims priority to TW Application Number 103207409, filed Apr. 28, 2014, which is herein incorporated by reference.

BACKGROUND

1. Technical Field

The present disclosure relates to universal serial bus (USB) connectors. More particularly, the present disclosure relates to USB connectors of Type C.

2. Description of Related Art

In our daily lives, electrical connectors of universal serial bus (USB) specifications are one of the most widely used transmission interfaces. Since the USB interface is convenient and easy to use, small in size and has a reasonable cost, the applications of USB can be found in various working fields. No matter for the core entertainment devices of a family such as televisions, personal notebook computers, smartphones or tablet devices, computers or printers in an office, or multimedia entertainment systems in a vehicle, USB devices are often used for the task of information transmission.

Apart from the convenient, quick and reliable transmission of information, USB further has another very convenient function: the electricity transmission through the mutual connection between the interfaces of the multimedia electronic devices. This is also referred to as charging. However, the charging of the existing USB devices can only provide a maximum of 7.5 W of power. Although this improvement of specification of power supply can comply with the charging requirements of hand-held portable devices such as mobile phones or music media player of MP3, this is a generally time-consuming method to charge a USB device. In addition, this is inadequate to satisfy with the power supply of large and power consuming products such as screen monitors or notebook computers.

In order to popularize the application of USB on the power supply of various devices, provide multimedia electronic devices which is easy to carry and slimmer, and reduce the situation of transmission failure caused by the wrong direction of insertion or connection of the USB, a brand new universal serial bus of Type C appears accordingly. The USB Implementers Forum (USB-IF) has announced recently the standard specification of this USB interface of Type C. The power supply requirements of various devices can be fulfilled by utilizing a single USB cable with a power transmission as high as 100 W. This can shorten the charging time for the devices, and also optimize the convenience of the mobile application.

Moreover, the interface of USB of Type C can support the brand new slim design of various devices including mobile phones, tablet computers, combo products, notebook computers, desktop computers and devices of many other specific purposes. This slim interface of new standard of the industry can transmit information, power and video, and will become the only interface required by the combination of transmissions of various devices. Since the synchronization of information transmission has been largely increasing, corresponding electromagnetic radiations may be produced during use, interfering the normal operation of other electronic elements. Therefore, the method of grounding is commonly used by the industry to reduce the production of electromagnetic interference (EMI).

As shown in FIGS. 14-15, the Taiwan patent M367498 provides an electrical connector A100. The electric connector A100 includes an insulating casing A1, a metal casing A2 covering the insulating casing A1 and a plurality of conductive terminals A3. The insulating casing A1 includes a rear wall A12 which stands upright, and two side walls A13 extended forwards as a unity from the two ends of the rear wall A12. Moreover, the insulating casing A1 is disposed with a tongue sheet A11. The tongue sheet A11 is substantially extended forwards as a unity from the front of the rear wall A12. The inner walls of the two side walls A13 are disposed with a plurality of openings facing the groove (not shown in the Figs.) of the tongue sheet A11, forming the first, second and third wall surface A131, A132 and A133 in a shape of steps, in which the first wall surface A131 is closest to the bottom wall (not shown in the Figs.) The second wall surface A132 is located between the first wall surface A131 and the third wall surface A133.

The metal casing A2 is formed from a metal sheet, surrounding the side wall A13, top wall (not shown in the Figs.) and bottom wall (not shown in the Figs.) of the insulating casing A1. The top wall (not shown in the Figs.) of the metal casing A2 forms a docking chamber (not shown in the Figs.) with the side wall A13 and the rear wall A12 of the insulating casing A1. The tongue sheet A11 extends into the docking chamber (not shown in the Figs.) from a first direction. The top wall (not shown in the Figs.) and the bottom wall (not shown in the Figs.) of the metal casing A2 are respectively disposed with elastic arms A22 extending towards the docking chamber (not shown in the Figs.), in order to achieve the holding and grounding function to the plug connector (not shown in the Figs.). The front edge of the top wall (not shown in the Figs.) and the bottom wall (not shown in the Figs.) bend outwards, and are punched with a touching sheet A23. The touching sheet A23 can be used for the touching of chassis (not shown in the Figs.) like computers. The two sides of the metal casing A2 extend downwards to form the pins A24. On the other hand, a grounding plate A7 is located between the first surface A110 and the second surface (not shown in the Figs.) of the tongue sheet A11. The dimension of the grounding plate A7 is substantially the same as the area of the tongue sheet A11. The two sides (not shown in the Figs.) of the grounding plate A7 substantially align with the two side surfaces A112 of the tongue sheet A11, without protruding the two side surfaces A112 of the tongue sheet A11. The front end slightly contracts inwards relative to the front end surface A113. The rear end of the grounding plate A7 is disposed with a welding leg A71 as a unity. The welding leg A71 is connected to the grounding circuit of the circuit board (not shown in the Figs.)

SUMMARY

A technical aspect of the present disclosure provides a universal serial bus (USB) connector, which belongs to a USB connector of Type C. It utilizes a bump of a shielding case to electrically connect with a grounding sheet, or utilizes a shielding case to mutually and electrically connect with a grounding sheet through a method of laser welding. This method of utilizing an external shielding case to shield against electromagnetic radiation, is used to reduce the mutual electromagnetic interference between the electronic signals during operation of the electronic elements and to strengthen the general reliability of the signal transmission of the electronic circuit of the connector. In addition, the product design of the structure of the grounding sheet and the shielding case are relatively simple, which can effectively enhance the yield of mass production of the final product.

According to an embodiment of the present disclosure, the USB connector includes a shielding case, an insulating main body, a first terminal group, a second terminal group and a grounding sheet. The first terminal group and the second terminal group are accommodated in the insulating main body. The insulating main body is accommodated in the shielding case. The grounding sheet is fixed on the insulating main body. A surface of the shielding case has at least one bump. The bump is recessed inwards from the surface, such that the bump is electrically connected with the grounding sheet. The insulating main body has a base portion, the base portion extends to form a tongue plate, and the grounding sheet is located between the base portion and the tongue plate by insert molding.

According to an embodiment of the present disclosure, the grounding sheet is a metal conducting sheet. The exposed portion of the grounding sheet corresponds to the region of the bump and is electrically connected with the bump. The exposed portion of the grounding sheet near to the region of the bump is located on the region of the base portion of the insulating main body. The exposed portion of the grounding sheet and the base portion are located on different flat surfaces. This means the exposed portion of the grounding sheet slightly protrudes from the flat surface of the base portion, such that the exposed portion of the grounding sheet is electrically connected with the bump. On the other hand, the exposed portion of the grounding sheet is attached on the insulating main body by welding, such that the grounding sheet is electrically connected with the shielding case.

According to an embodiment of the present disclosure, an isolation plate is disposed at the center of the insulating main body. The first terminal group and the second terminal group are shielded and isolated from the insulating main body by the isolation plate. This means the shielding and isolation of the first terminal group and the second terminal group against the electromagnetic radiation by the isolation plate is enhanced. The first terminal group includes a first terminal and a first fixing portion. The first terminal is assembled on the first fixing portion. The second terminal group includes a second terminal and a second fixing portion. The second terminal is assembled on the second fixing portion.

According to an embodiment of the present disclosure, the grounding sheet is disposed with a main body portion. The main body portion is located on the region of the tongue plate of the insulating main body, extending outwards from the main body respectively forming a contact surface, a snapping portion and a positioning portion. The contact surface is located on the region of the base portion of the insulating main body. The contact surface is used to electrically connect with the bump. The snapping portion and the positioning portion are on the insulating main body by insert molding, configured to fix the grounding sheet on the insulating main body. The snapping portion and the isolation plate are located on the same flat surface, to facilitate the accommodation of the first terminal group and the second terminal group in the insulating main body. Moreover, the shielding case is covered outside the insulating main body and surrounds the tongue plate to form a docking space, to facilitate the fixing and installation of a docking plug on the electrical connector.

The other applications of the present disclosure become obvious by the disclosure of this specification. However, the disclosure of this specification is by the electrical connection between the grounding sheet of an insulating main body and a shielding case, in order to reduce the electromagnetic interference produced during the transmission of electronic signals. On the other hand, the internal design structure of the connector is simple. Thus, the production process can be simplified and the manufacturing cost can be reduced. It will be apparent to the person having ordinary skill in the art that various modifications and variations can be made to the structure of the present disclosure without departing from the scope or spirit of the present disclosure.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
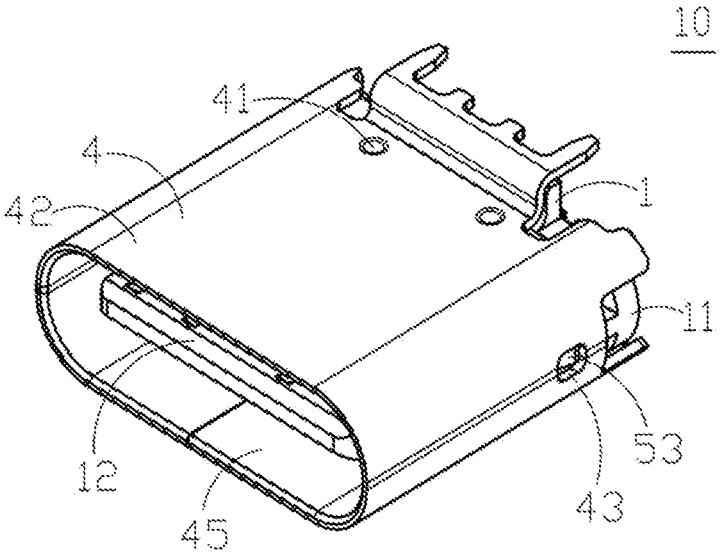
FIG. 1 is a perspective view of a universal serial bus connector in the first view angle according to the first embodiment of the present disclosure.

Drawings will be used below to disclose a plurality of embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
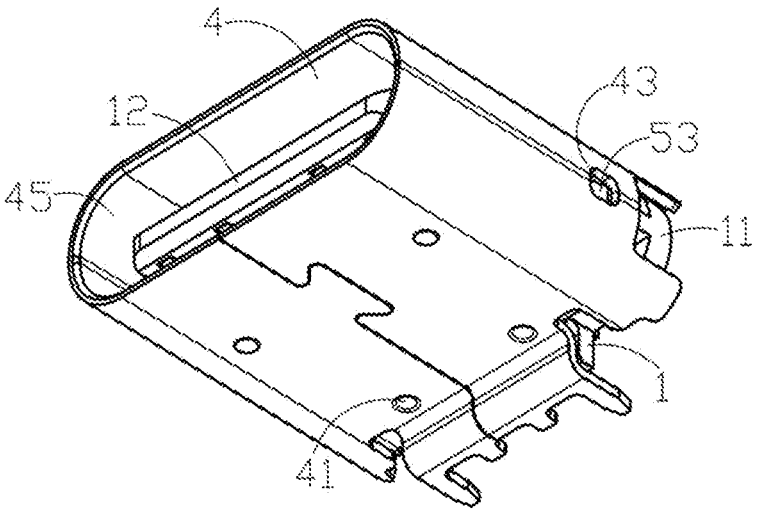
FIG. 2 is a perspective view of the universal serial bus connector of FIG. 1 in the second view angle.
Figure 3:
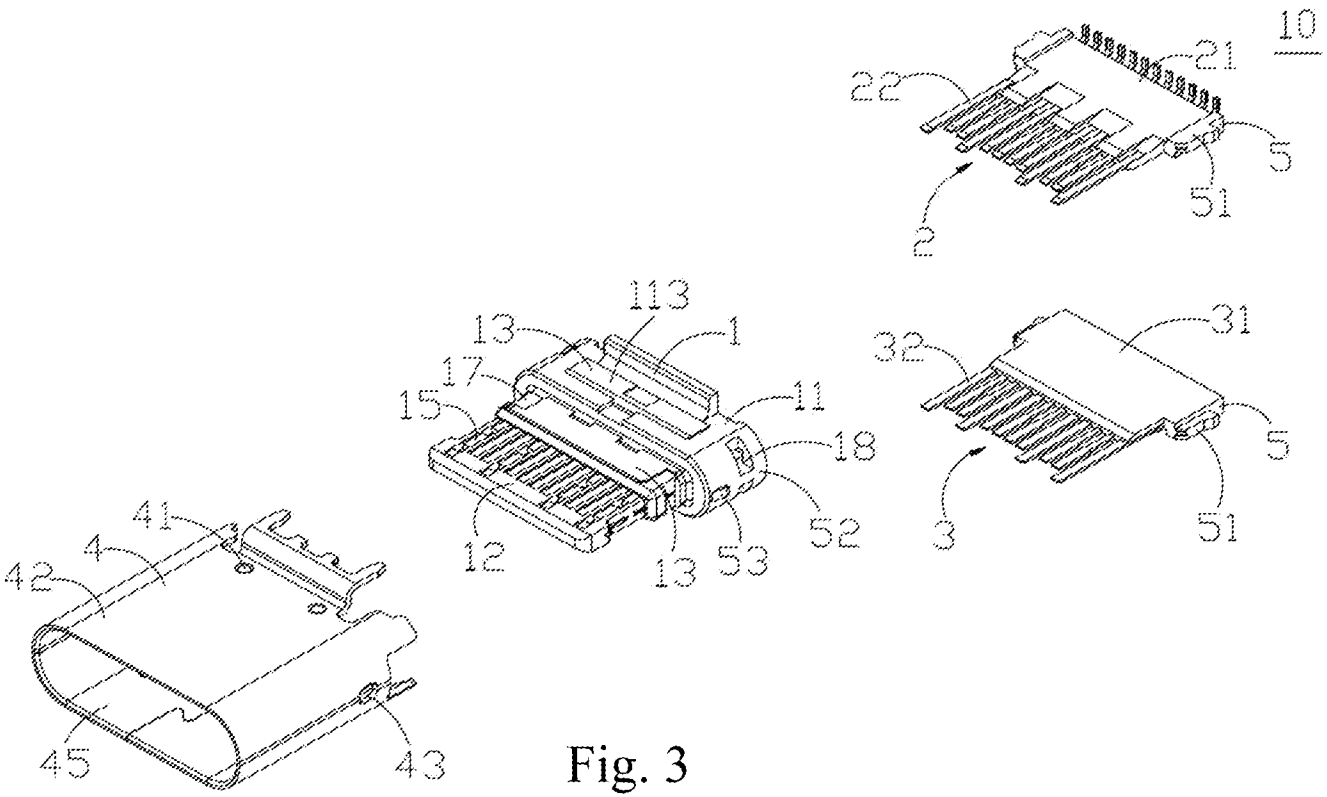
FIG. 3 is an exploded view of the universal serial bus connector of FIG. 1 in the first view angle.

As shown in FIGS. 1-3, the present disclosure provides a universal serial bus (USB) connector 10. More particularly, it belongs to a USB connector 10 of USB Type C. The USB connector 10 includes a shielding case 1, a first terminal group 2, a second terminal group 3, a shielding case 4 and a plurality of grounding sheets 13. The first terminal group 2 and the second terminal group 3 are accommodated in the insulating main body 1. The insulating main body 1 is accommodated in the shielding case 4. Each of the grounding sheets 13 is fixed on the insulating main body 1.

As shown in FIGS. 1-4, in the first embodiment of the present disclosure, the insulating main body 1 has a base portion 11. The base portion 11 extends outwards to form a tongue plate 12. Each of the grounding sheets 13 is fixed between the base portion 11 and the tongue plate 12. The base portion 11 forms a hollow casing 14. The insulating main body 1 is disposed with an isolation plate 16 at the center of the hollow casing 14 of the base portion 11. The first terminal group 2 and the second terminal group 3 are shielded and isolated from the insulating main body 1 by the isolation plate 16. This means the shielding and isolation of the first terminal group 2 and the second terminal group 3 against the electromagnetic radiation by the isolation plate 16 is enhanced. Moreover, the shielding case 4 is cut and bent to form a frame structure from a thin metal sheet by punching. The insulating main body 1 is accommodated in the shielding case 4. The surface 42 of the shielding case 4 has at least one bump 41. The bump 14 is recessed inwards from the surface 42, such that the bump 41 is electrically connected with the grounding sheet 13.

Figure 4:
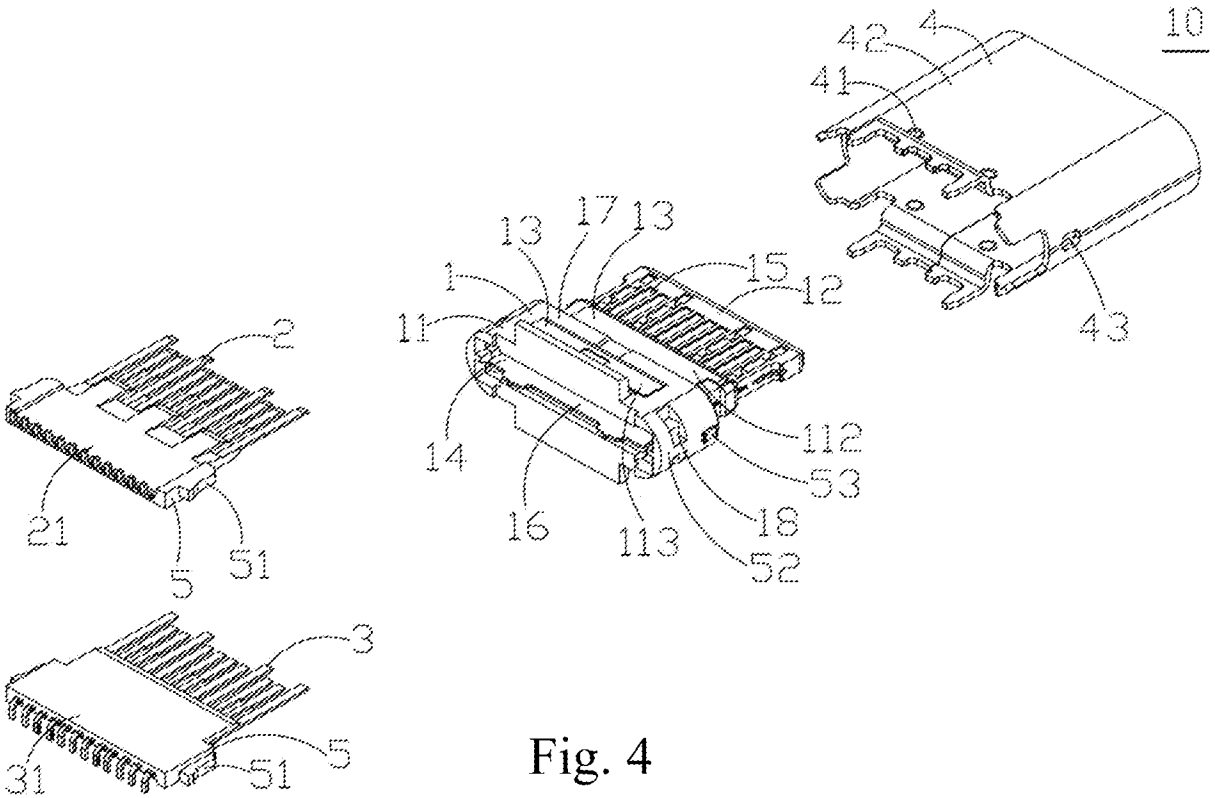
FIG. 4 is an exploded view of the universal serial bus connector of FIG. 1 in the second view angle.
Figure 5:
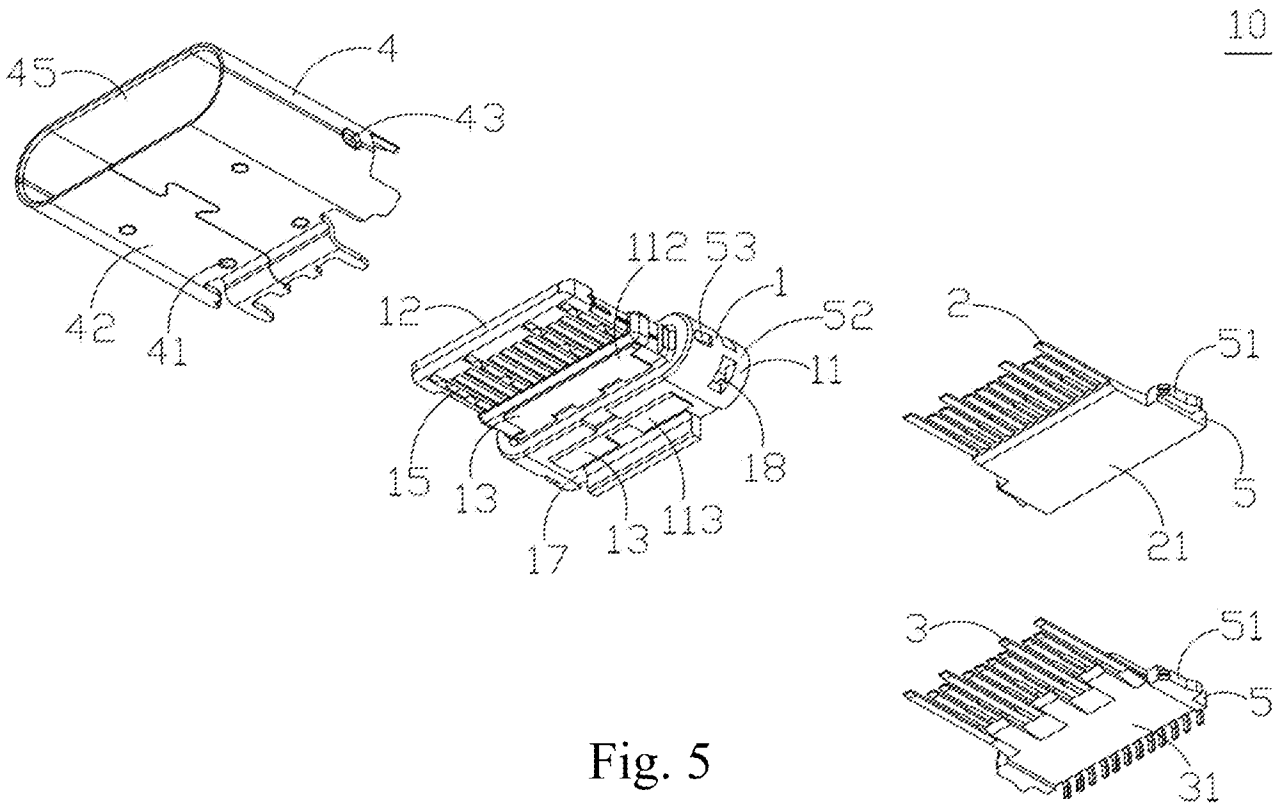
FIG. 5 is an exploded view of the universal serial bus connector of FIG. 1 in the third view angle.

As shown in FIGS. 4-5, in the first embodiment of the present disclosure, the grounding sheet 13 is a metal conducting sheet. The grounding sheet 13 is located between the base portion 11 and the tongue plate 12 by insert molding. The exposed portion of the grounding sheet 13 corresponds to the region of the bump 41 and is electrically connected with the bump 41. The exposed portion of the grounding sheet 13 near to the region of the bump 41 is located on the region of the base portion 11 of the insulating main body 1. The exposed portion of the grounding sheet 13 and the base portion 11 are located on different flat surfaces 17. This means the exposed portion of the grounding sheet 13 slightly protrudes from the flat surface 17 of the base portion 11, such that the exposed portion of the grounding sheet 13 is electrically connected with the bump 41.

As shown in FIGS. 3-5, in the first embodiment of the present disclosure, the first terminal group 2 includes a first terminal 22 and a first fixing portion 21. The first terminal 22 is assembled on the first fixing portion 21. The second terminal group 3 includes a second terminal 32 and a second fixing portion 31. The second terminal 32 is assembled on the second fixing portion 31. The tongue plate 12 is disposed with a plurality of slots 15. The first terminal 22 and the second terminal 32 are respectively accommodated in each of the slots 15. The first fixing portion 21 and the second fixing portion 31 are respectively disposed with a plurality of locking pieces 51 on the two side edges 5. The base portion 11 is disposed with a plurality of locking grooves 18 corresponding to the locking pieces 51. The locking pieces 51 are respectively locked to the corresponding locking grooves 18, such that the first terminal group 2 and the second terminal group 3 are accommodated in the insulating main body 1.

Figure 6:
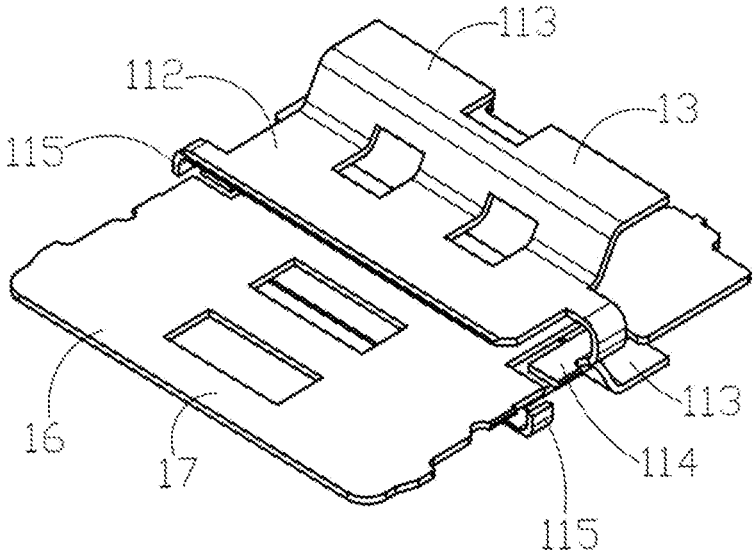
FIG. 6 is a perspective view of the grounding sheet and the isolation plate of FIG. 1 in the first angle.
Figure 7:
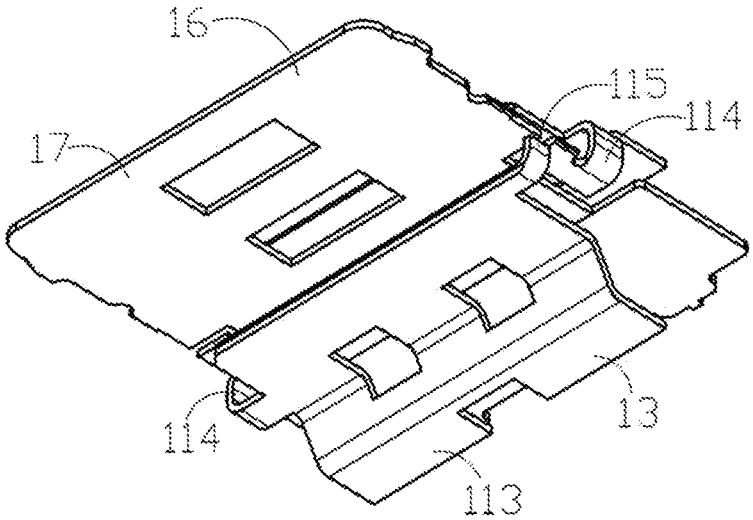
FIG. 7 is a perspective view of the grounding sheet and the isolation plate of FIG. 1 in the second angle.
Figure 8:
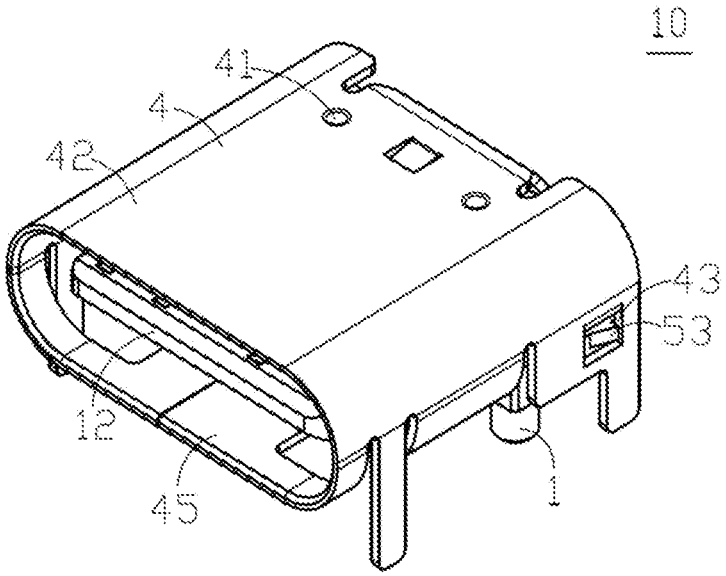
FIG. 8 is a perspective view of a universal serial bus connector in the first view angle according to the second embodiment of the present disclosure.
Figure 9:
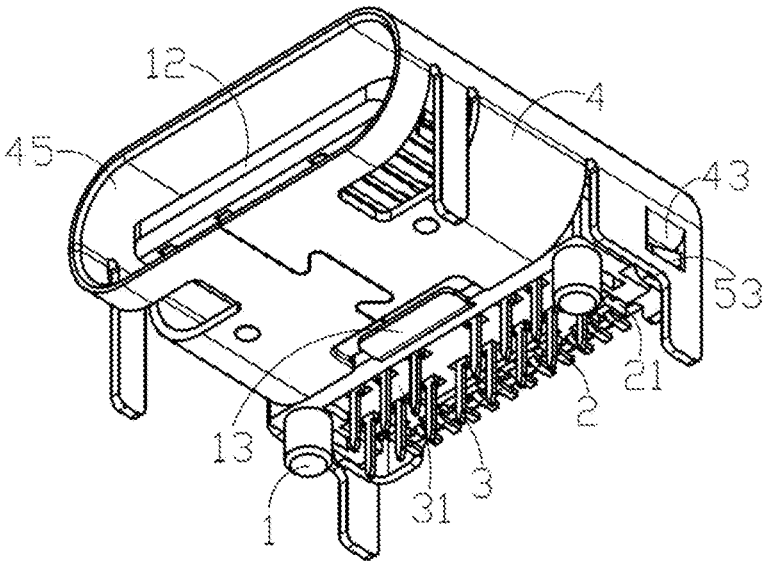
FIG. 9 is a perspective view of the universal serial bus connector of FIG. 8 in the second view angle.
Figure 10:
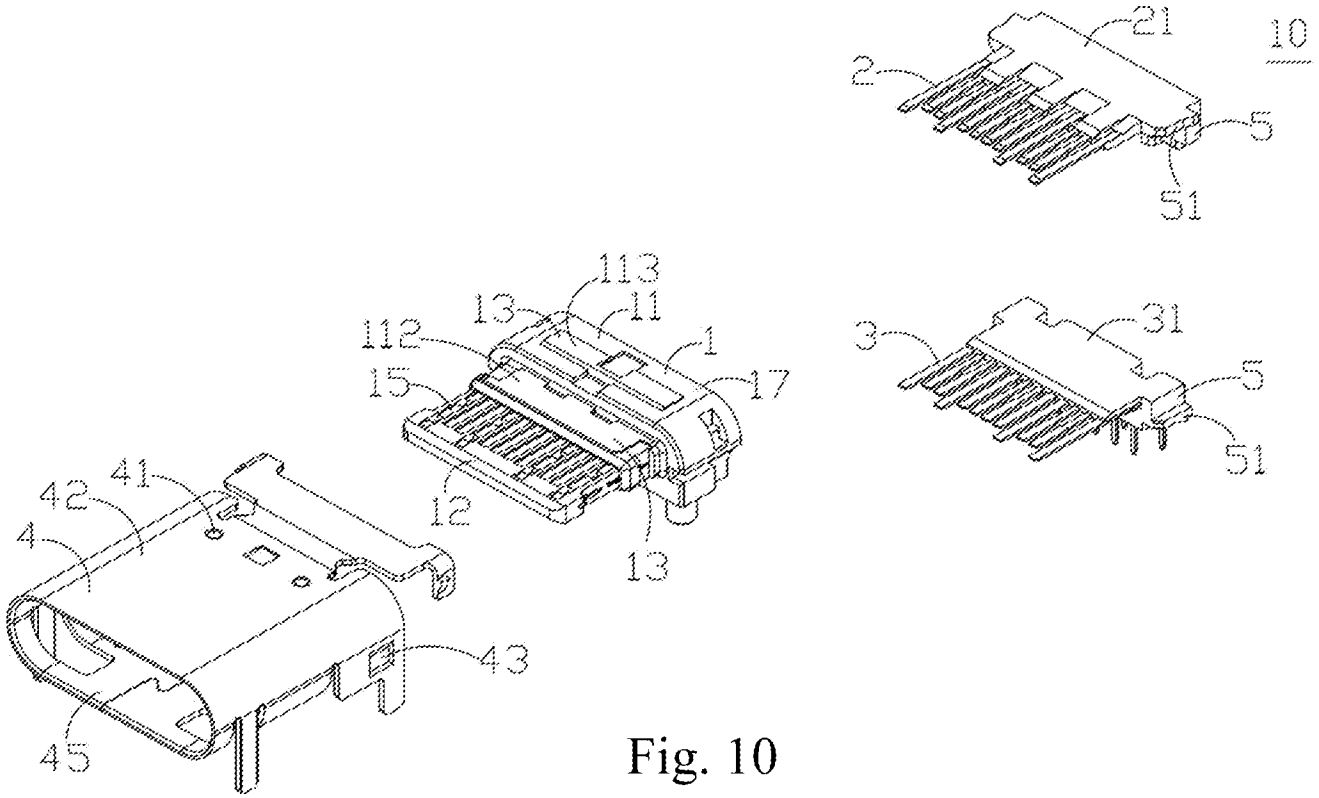
FIG. 10 is an exploded view of the universal serial bus connector of FIG. 8 in the first view angle.
Figure 11:
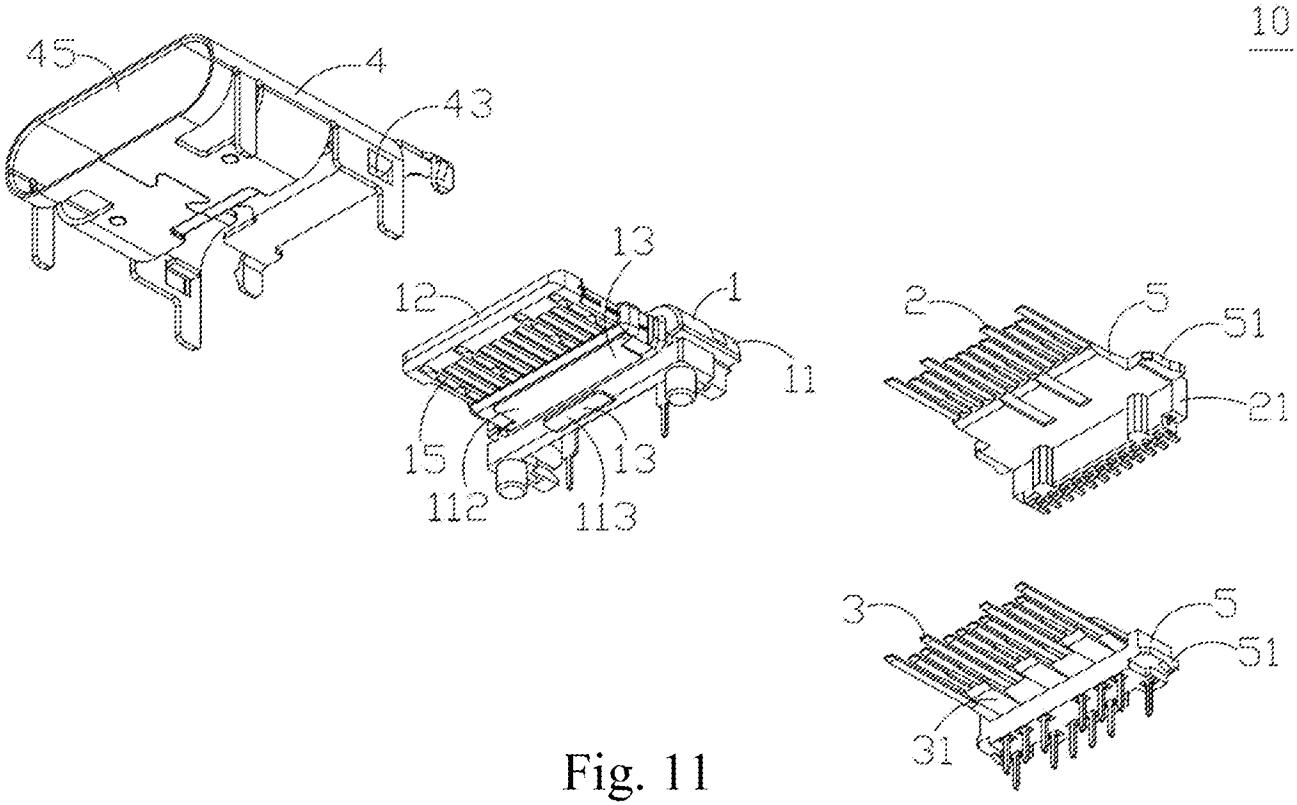
FIG. 11 is an exploded view of the universal serial bus connector of FIG. 8 in the second view angle.
Figure 12:
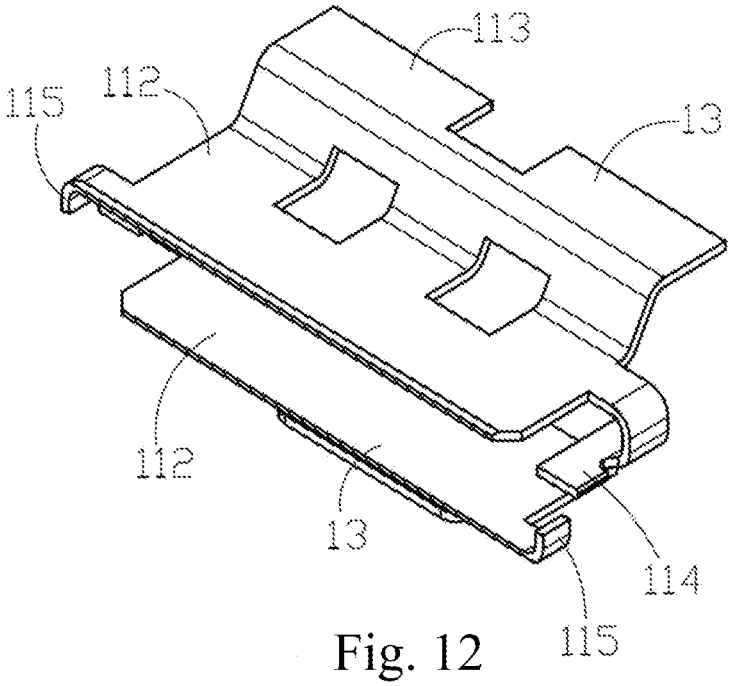
FIG. 12 is a perspective view of the grounding sheet of FIG. 8 in the first view angle.
Figure 13:
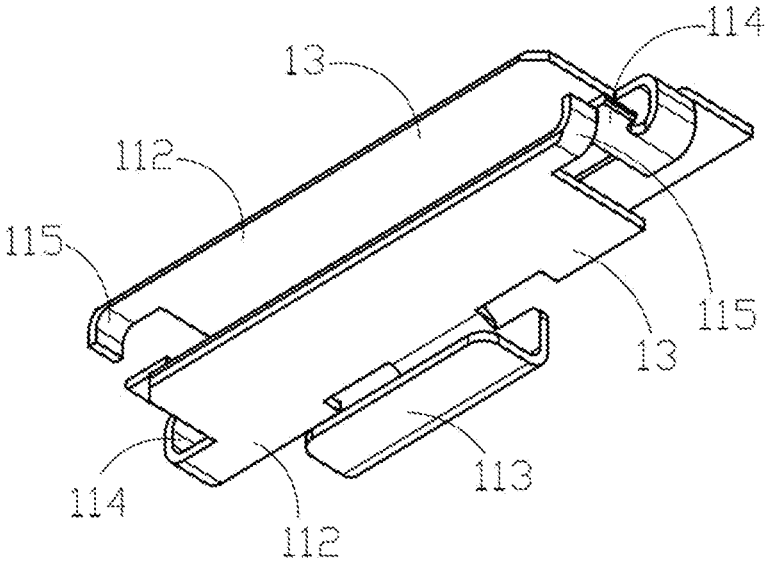
FIG. 13 is a perspective view of the grounding sheet of FIG. 8 in the second view angle.
Figure 14:
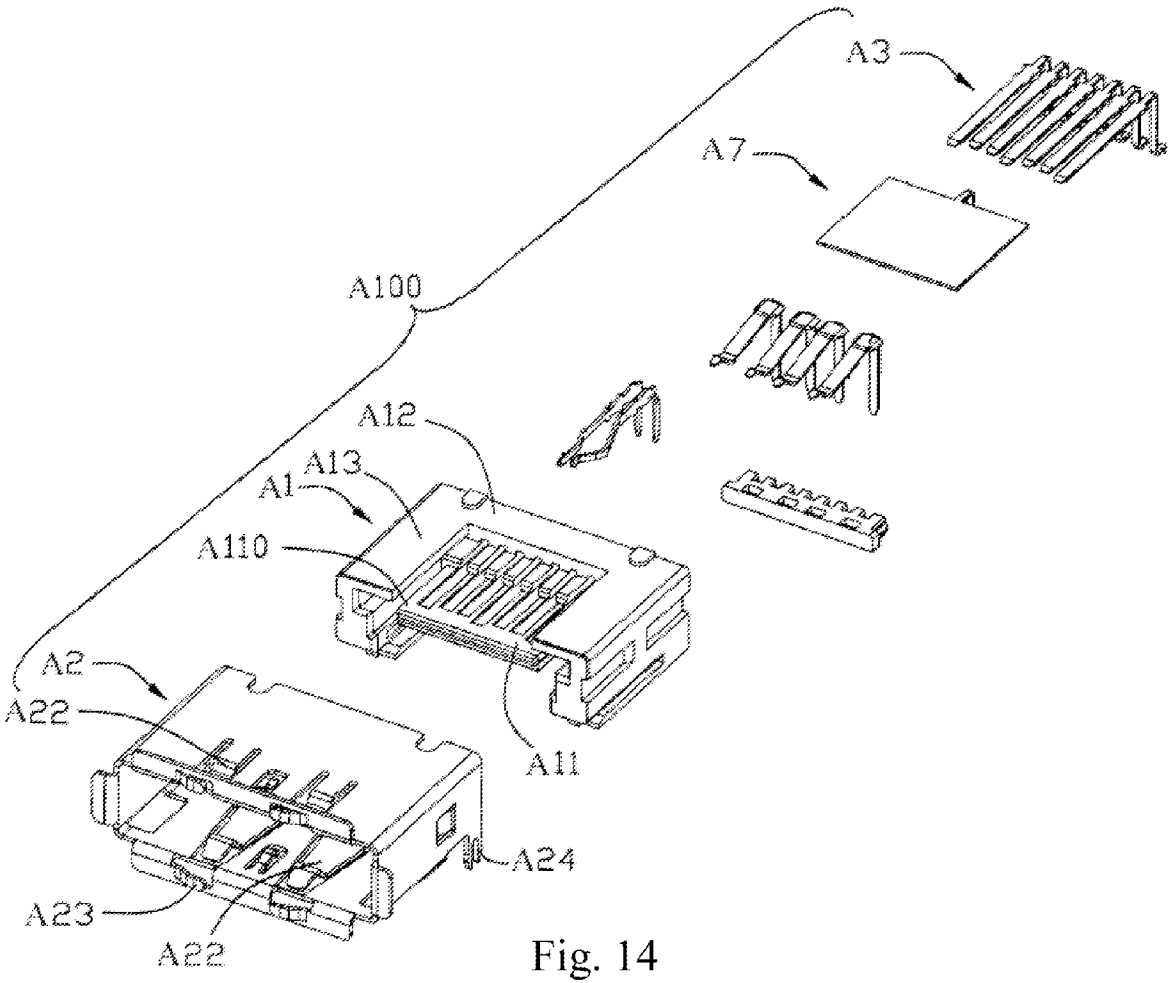
Fig. 14 (Prior Art)
FIG. 14 is an exploded view of the electrical connector previously disclosed in Taiwan patent M367498.
Figure 15:
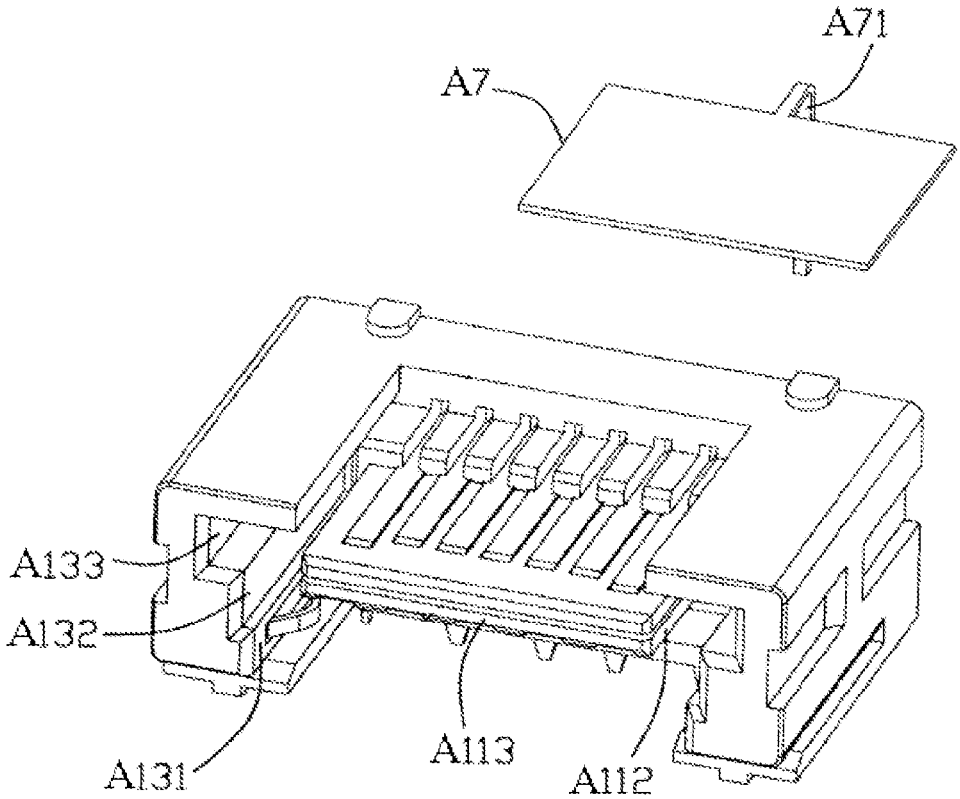
Fig. 15 (Prior Art)
FIG. 15 is an exploded view of the insulating main body and the grounding sheet of the electrical connector previously disclosed in Taiwan patent M367498.

As shown in FIGS. 5-7, in the first embodiment of the present disclosure, the grounding sheet 13 is disposed with a main body portion 112. The main body portion 112 is located on the region of the tongue plate 12 of the insulating main body 1, extending outwards from the main body 112 respectively forming a contact surface 113, a snapping portion 114 and a positioning portion 115. The contact surface 113 is located on the region of the base portion 11 of the insulating main body 1. The contact surface 113 is used to electrically connect with the bump 41. The snapping portion 114 and the positioning portion 115 are on the insulating main body 1 by insert molding, configured to fix the grounding sheet 13 on the insulating main body 1. The snapping portion 114 and the isolation plate 16 are located on the same flat surface 17, to facilitate the accommodation of the first terminal group 2 and the second terminal group 3 in the insulating main body 1. Moreover, the two side walls 52 of the insulating main body 1 are disposed with a plurality of stoppers 53. The shielding case 4 has a plurality of notches 43 corresponding to the stoppers 53. When the insulating main body 1 is accommodated in the shielding case 4, each of the stoppers 53 stops and fixes at each of the notches 43, such that the insulating main body 1 cannot be removed and separated from the shielding case 4. Afterwards, the shielding case 4 is covered outside the insulating main body 1 and surrounds the tongue plate 12 to form a docking space 45, to facilitate the fixing and installation of a docking plug (not shown in the Figs.) on the USB connector 10.

As shown in FIGS. 8-13, in the second embodiment of the present disclosure, the exposed portion of the grounding sheet 13 can be partially attached to the insulating main body 1 by external workmanship of laser welding, such that the grounding sheet 13 and the shielding case 4 are electrically connected. Since the exposed portion of the grounding sheet 13 is partially attached to the outside of the insulating main body 1, the condition of the insufficiency of the structural supporting force outside the insulating main body 1 can be indirectly reinforced. Moreover, by the external workmanship of laser welding, the electrical connection between the grounding sheet 13 and the shielding case 4 is enhanced, further increasing the effect of electromagnetic shielding for the overall electronic circuit of the USB connector 10.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. An universal serial bus connector, comprising:

a shielding case;

an insulating main body accommodated and installed in the shielding case;

a first terminal group accommodated in the insulating main body;

a second terminal group accommodated in the insulating main body; and a grounding sheet fixed on the insulating main body, a surface of the shielding case having at least one bump, the bump being recessed inwards from the surface, such that the bump is electrically connected with the grounding sheet.

2. The universal serial bus connector of claim 1, wherein the insulating main body has a base portion, the base portion extends to form a tongue plate, and the grounding sheet is located between the base portion and the tongue plate by insert molding.

3. The universal serial bus connector of claim 2, wherein the shielding case covers outside the insulating main body and surrounds the tongue plate to form a docking space.

4. The universal serial bus connector of claim 1, wherein the grounding sheet is a metal conducting sheet, and an exposed portion of the grounding sheet is electrically connected with the bump.

5. The universal serial bus connector of claim 4, wherein the exposed portion of the grounding sheet is attached on the insulating main body by welding, such that the grounding sheet is electrically connected with the shielding case.

6. The universal serial bus connector of claim 1, wherein an isolation plate is disposed at the center of the insulating main body, and the first terminal group and the second terminal group are shielded and isolated from the insulating main body by the isolation plate.

7. The universal serial bus connector of claim 1, wherein the first terminal group comprises a first terminal and a first fixing portion, and the first terminal is assembled on the first fixing portion.

8. The universal serial bus connector of claim 1, wherein the second terminal group comprises a second terminal and a second fixing portion, and the second terminal is assembled on the second fixing portion.

* * * * *